United States Patent [19]

Makita

[11] Patent Number: 4,772,142

[45] Date of Patent: Sep. 20, 1988

[54] DOCUMENT PROCESSING SYSTEM

[75] Inventor: Masaru Makita, Tokyo, Japan

[73] Assignee: Canon Kabushiki Kaisha, Tokyo, Japan

[21] Appl. No.: 133,240

[22] Filed: Dec. 14, 1987

Related U.S. Application Data

[63] Continuation of Ser. No. 807,958, Dec. 12, 1985, abandoned.

[30] Foreign Application Priority Data

Dec. 17, 1984 [JP] Japan ..... 59-264568
Dec. 17, 1984 [JP] Japan ..... 59-264569

[51] Int. Cl.[4] ..... B41J 1/30; B41J 1/56; B41J 19/32

[52] U.S. Cl. ..... 400/144.2; 400/175; 400/303; 400/711

[58] Field of Search ..... 400/83, 144.2, 144.3, 400/171, 175, 303, 306, 711

[56] References Cited

U.S. PATENT DOCUMENTS

| | | | |
|---|---|---|---|
| 3,346,087 | 10/1967 | Colombo et al. | 400/306.1 |
| 3,403,386 | 9/1968 | Perkins et al. | 364/900 |
| 3,557,929 | 1/1971 | Schaaf | 400/611 |
| 3,618,032 | 11/1971 | Goldsberry et al. | 364/900 |
| 3,888,340 | 6/1975 | Hoffman | 400/611 |
| 4,074,798 | 2/1978 | Berger | 400/144.2 |
| 4,147,440 | 4/1979 | Mishark et al. | 400/611 |
| 4,169,685 | 10/1979 | Gruber | 400/279 |
| 4,209,262 | 6/1980 | Savage | 400/144.2 |
| 4,240,758 | 12/1980 | Acosta | 400/279 |
| 4,272,204 | 6/1981 | Quinn, Jr. et al. | 400/708 X |
| 4,281,938 | 8/1981 | Phillips | 400/171 |

FOREIGN PATENT DOCUMENTS

| | | | |
|---|---|---|---|
| 0148679 | 9/1982 | Japan | 400/705.1 |
| 2087115 | 5/1982 | United Kingdom | 400/83 |

OTHER PUBLICATIONS

*IBM Tech. Disc. Bulletin,* by J. M. Cooper, vol. 19, No. 11, Apr. 1977, p. 4242, 400-175.

IBM Technical Disclosure Bulletin, "Enhanced Margin Cursor," vol. 24, No. 8 Jan. 1982, pp. 4354–4355.

IBM Technical Disclosure Bulletin, "Selectable Margin Scale," Brown, vol. 20, No. 10 Mar. 1978, pp. 4006–4007.

IBM Technical Disclosure Bulletin, "Illuminated Margin Scales," Taylor, vol. 21, No. 11, Apr. 1979, p. 4588.

IBM Technical Disclosure Bulletin, "Digital Margin Scale," Lisk et al., vol. 22, No. 1 Jun. 1979, pp. 196–197.

IBM Technical Disclosure Bulletin, "Electronic Print Position Indicator and Margin Scale Indicator for Interactive Ink Jet Printers," Hill et al., vol. 22, No. 7, Dec. 1979, pp. 2814–2815.

*Primary Examiner*—Paul T. Sewell

*Attorney, Agent, or Firm*—Fitzpatrick, Cella, Harper & Scinto

[57] ABSTRACT

A document processing system has a pitch key for generating character pitch information, an MPU for counting the character pitch information to set auto mode data in an auto mode selection memory RAM, a wheel sort memory RAM for storing printing pitch information of a printing wheel loaded in the system, a display unit for displaying the auto printing pitch setting mode and the detected printing pitch in a combination of different display patterns, and a display controller for controlling the display unit in response to the data read out from the RAMs under the control of the MPU.

8 Claims, 7 Drawing Sheets

| WHEEL SORT | A | 10 | 12 | 15 | PS | ARAM STATUS | WRAM STATUS |
|---|---|---|---|---|---|---|---|
| PICA WHEEL (10 PITCH) | A | 10 | | | | ON | 0 |
| ELITE WHEEL (12 PITCH) | A | | 12 | | | ON | 1 |
| MICRON WHEEL (15 PITCH) | A | | | 15 | | ON | 2 |
| PICA (10 PITCH)-BASED PROPORTIONAL WHEEL | A | 10 | | | PS | ON | 3 |
| ELITE (12 PITCH)-BASED PROPORTIONAL WHEEL | A | | 12 | | PS | ON | 4 |
| MICRON (15 PITCH)-BASED PROPORTIONAL WHEEL | A | | | 15 | PS | ON | 5 |

DOCUMENT PROCESSING SYSTEM

This application is a continuation of application Ser No. 807,958 filed 12/12/85, now abandoned.

BACKGROUND OF THE INVENTION

1. Field of the Invention

The present invention relates to a document processing system and, more particularly, to a document processing system with printing pitch change and display functions.

2. Description of the Prior Art

In conventional typewriters or the like, so-called proportional printing can be performed wherein the pitch of characters to be printed can be arbitrarily changed. Predetermined pitches are assigned to the character type to be used. A carriage drive controls positions of characters to be printed in accordance with the predetermined pitch. Three pitches, i.e., 10 pitch (pica), 12 pitch (elite) and 15 pitch (micron) are adapted as references for proportional printing elements. Type widths and shapes of printing elements (e.g., printing wheels) are determined in accordance with the pitch references. A user must set the reference pitch at a keyboard or switch means so as to obtain printing that matches the mounted printing wheel. An electronic typewriter with an automatic printing pitch setting function has been recently developed. According to this typewriter, a reference pitch of a printing wheel set in the typewriter is automatically detected optically or by the shape of the wheel, and the corresponding printing pitch can be automatically set.

It is important for an operator to properly know which printing pitch is currently set in the document processing apparatus. However, printing pitch information varies. For example, normal manual printing pitches consist of pica (10 characters/inch, fixed), elite (12 characters/inch, fixed), micron (15 characters/inch, fixed), pica-based proportional 1, elite-based proportional 2, and micron-based proportional 3. When information representing whether or not the pitch is manually selected or automatically selected in accordance with the pitch of the printing wheel loaded in the document processing apparatus is included in the display information, the amount of displayed information is increased. Therefore, the number of components for pitch selection and display operations is increased, thus requiring a large space. Furthermore, in a conventional document processing apparatus, the user must open the cover and insert a printing element upon energization of the apparatus.

SUMMARY OF THE INVENTION

The present invention has been made in consideration of the above situation, and has as its object to provide a document processing system wherein many sorts of printing pitch selection information can be displayed within a limited display area with good readability.

It is another object of the present invention to provide a document processing system, wherein "Auto" representing an automatic printing pitch setting mode is displayed in combination with printing pitch information in accordance with the sort of printing wheel mounted in the apparatus, so that many sorts of printing pitch information can accurately be displayed with a small number of components, thereby achieving good display readability and causing no operation erros.

DETAILED DESCRIPTION OF THE PREFERRED EMBODIMENTS

It is readily understood that a system according to the present invention can include a single apparatus or part of a system and can be different from that of the particular arrangement of the present invention described below.

The present invention will be described in detail with reference to preferred embodiments in conjunction with the accompanying drawings.

Figure 1:
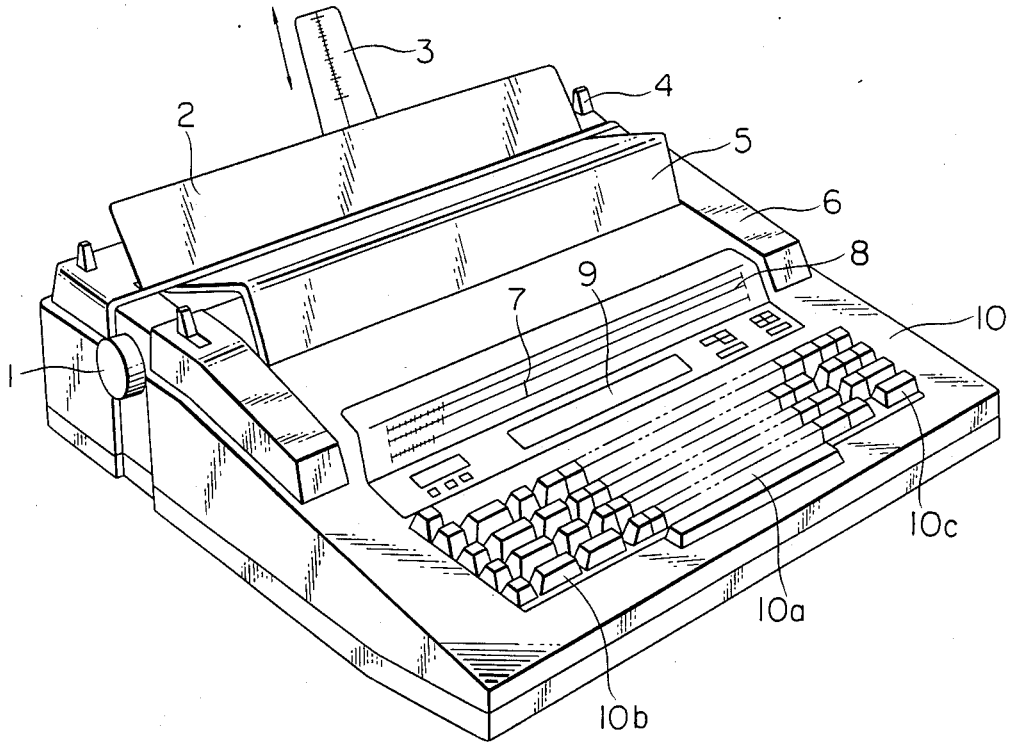
FIG. 1 is a perspective view of an electronic typewriter according to an embodiment of the present invention.

FIG. 1 is a perspective view showing an outer appearance of an electronic typewriter according to an embodiment of the present invention. Referring to FIG. 1, a platen knob 1 is used to manually load a sheet or finely adjust a vertical printing position. When the knob 1 is pushed inward, the knob 1 is disengaged from a drive pulse motor, and the knob 1 can be manually rotated. A paper support 2 is a paper guide plate which allows even a thin sheet to be set such that a printing surface of the sheet can always face the operator. A page end indicator 3 is a scale for indicating a length up to the last line of the sheet. The indicator 3 is adjusted by the operator in the advance in vertical direction indicated by the arrows in accordance with the sheet length. When the leading side of the sheet passing around the platen reaches the scale position of the indicator 3, the length up to the last line of the sheet can be visually recognized by the operator. A release lever 4 is used to release a pinch roller from the platen to manually check the inclination of the sheet. The pitch roller is arranged at the lower portion of the platen. A soundproof cover 5 reduces impact sounds upon impact printing. Since the soundproof cover 5 is made of a transparent acrylic resin, the printed characters can be checked by the operator through the soundproof cover 5. The operator rotates an upper cover 6 backward when he changes the type element or replaces the used ribbon cassette with a new one. The electronic typewriter employs 10-character or pica printing pitch, 12-character or elite printing pitch, 15-character or micron printing pitch, pica-based proportional spacing (to be referred to as a PS hereinafter), elite-based PS, and micron-based PS. A scale 8 consists of 10-, 12- and 15-pitch scales. A carriage indicator 7 has three lamps such as LEDs. The lamps are mounted in the carriage and the lamps corresponding to the pitch specified at a keyboard 10 are turned on, thereby indicating the carriage position on the scale 8. The keyboard 10 consists of character keys 10*a* for entering the characters and control keys 10*b* and 10*c* arranged at both sides of the character keys 10*a*.

Figure 2:
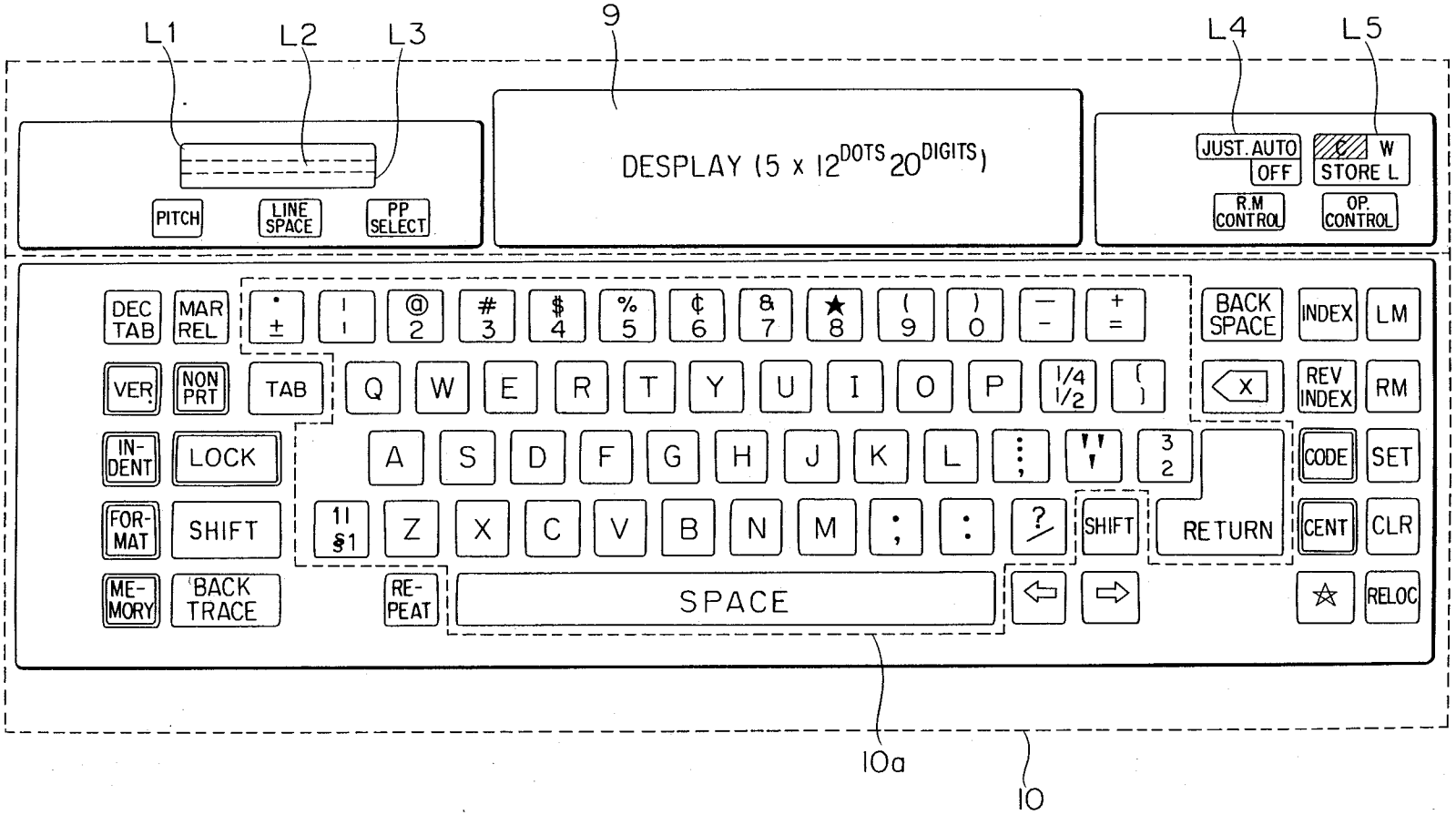
FIG. 2 is a front view of an operation panel in the electronic typewriter of FIG. 1.
Figures 6A, 6B:
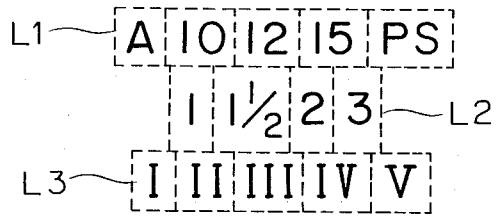
FIG. 6A is a partial enlarged view of display areas.
FIG. 6B is a table for explaining display control of the display area L1.

FIG. 2 is a front view of the operation panel of the electronic typewriter. Referring to FIG. 2, the "Pitch" key specifies a printing pitch (the number of characters) per inch. The details of a display area L1 upon operation of the "Pitch" key are shown in FIG. 6A. In the pitch display area L1 consituted by LEDs or the like, display patterns "A", "10", "12", "15" and "PS" are cyclically turned on upon every depression of the "Pitch" key. The display patterns "10", "12" and "15" are given in units of the number of characters/inch. When the display pattern "10", "12" or "15" is singly displayed, it indicates that printing pitch has been manually selected. When the pattern "A" is displayed in the display area L1, the printing pitch is automatically detected in accordance with the actual printing pitch of the printing element mounted in the apparatus. The pattern "A" is displayed together with one of the "10", "12", "15" and "PS" pitches. This display mode will be described later.

The "Line Space" key specifies the feed lines. A unit feed lengths 1 is 1/6 inch. In this case, the letters and numbers in a display area L2 are cyclically turned on. The "PP Select" key is a key for spec1fying the printing pressure. The display patterns in a display area L3 are cyclically turned on upon every depression of the "PP Select" key. The upper right "R.M Control" key specifies the right margin in the electronic typewriter. One of "JUST", "AUTO" or "OFF" modes for the right margin is selected upon depression of the "R.M Control" key. The "JUST", AUTO"and "OFF" lamps in a display area L4 are cyclically displayed. When the "JUST" lamp is turned on, a printout can be justified at the right margin. When the "AUTO" lamp is turned on, the auto line feed is performed. When the OFF lamp is turned on, no function is effected. The "OP Control" key is used to set the printing mode of the electronic typewriter. The C, W, L and STORE lamps are cyclically turned on upon every depression of the "OP Control" key. When the C lamp is turned on, input information is printed out in units of characters. When the W lamp is turned on, the input information is printed out in units of words. When the L lamp is turned on, input information is printed in units of lines. When the STORE lamp is turned on, the input information is stored in an internal memory (i.e., a text buffer). When input information is stored, it is printed out in units of lines. The "MEMORY" key is used to edit character strings (sentences) and start accessing the internal memory.

Figure 3:
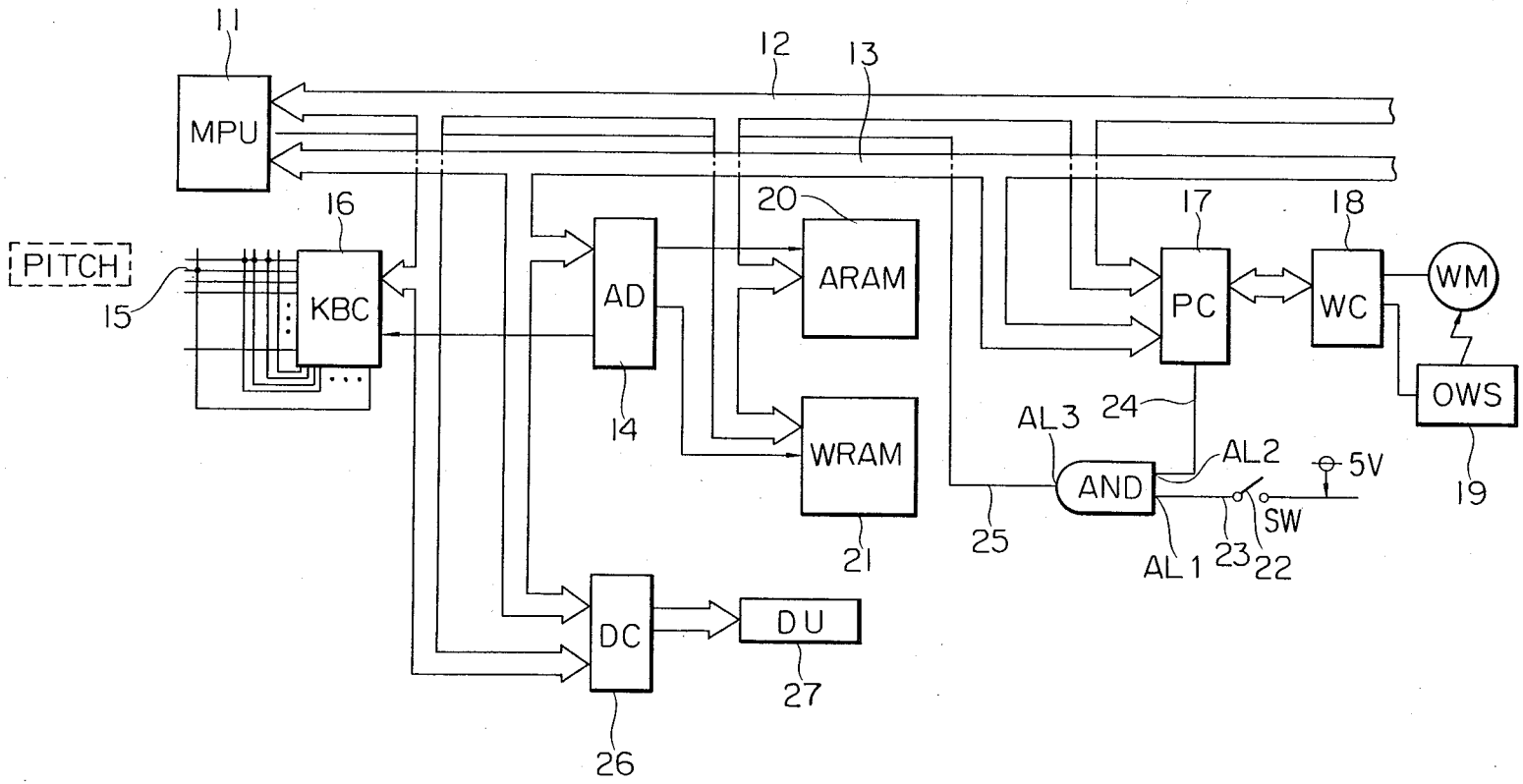
FIG. 3 is a block diagram for explaining the operation of the typewriter of FIG. 1.

FIG. 3 is a block diagram for explaining the operation of the embodiment described above. Referring to FIG. 3, a microprocessor (MPU) 11 controls and monitors the overall operation of the apparatus. The I/O ports of the MPU 11 are expanded through a data bus (DB) 12 and an address bus (AB) 13 so as to cause the MPU 11 to easily send instructions and transmit data. An address decoder (AD) decodes address data on the address bus 13.

When the operator depresses the "Pitch" key, a contact 15 is electrically connected to a corresponding terminal in the same manner as in other way switches on the keyboard. A coded pitch selection instruction signal is sent from a keyboard controller (KBC) 16 to the MPU 11. The MPU 11 counts the pitch selection instruction signals. When the instruction represents the "Auto" mode, an ON signal is stored in an auto mode selection memory RAM (ARAM) 20. In a cycle for selecting another manual pitch, an OFF signal is written in the ARAM 20. A wheel sort memory RAM (WRAM) 21 comprises a random access memory for storing the printing pitch information corresponding to the pitch sort information detected from a printing element (printing wheel) loaded in the apparatus.

A printer controller (PC) 17 controls a printer unit in the apparatus. The PC 17 is connected to a wheel controller (WC) 18. The WC 18 is connected to a wheel pulse motor (WM) and an optical wheel sensor (OWS) 19, so that the WC 18 can select the printing type and detect the pitch information of the wheel loaded in the apparatus. A switch (SW) 22 interlocked with opening/closing of the upper cover 6 in FIG. 1 is arranged to allow change of the printing wheel and the ribbon. When the upper cover 6 of the typewriter is opened, the switch 22 causes an AND gate input terminal AL1 to be set at low level through line 23. However, when the upper cover 6 is closed, the switch 22 causes the terminal AL1 to be set at high level. An input terminal AL2 of the 2-input AND gate receives the output signal from the PC 17. When the PC 17 for constantly monitoring the printer detects the normal operating state of the printer, a signal of high level appears on a line 24. However, when the PC 17 detects an abnormal state such as an end of ribbon, a signal of low level appears on the line 24. When both the input terminals AL1 and AL2 are set at high level, (i.e., when the upper cover 6 is closed and the printer is normally operated), an output terminal AL3 is set at high level. The signal of high level from the terminal AL3 is supplied to the MPU 11 through a line 25. Therefore, the MPU 11 can detect in response to the output signal from the AND gate whether or not the printer is operated normally. When one printing wheel is replaced with another, the MPU 11 receives data corresponding to the new printing wheel from the OWS 19, thereby discriminating the pitch of the new printing wheel loaded in the apparatus.

The apparatus also has a display controller (DC) 26 as a display control means. The DC 26 controls a display unit (DU) 27 on the operation panel, thereby displaying the above-mentioned printing pitch information or the like.

Figure 4A:
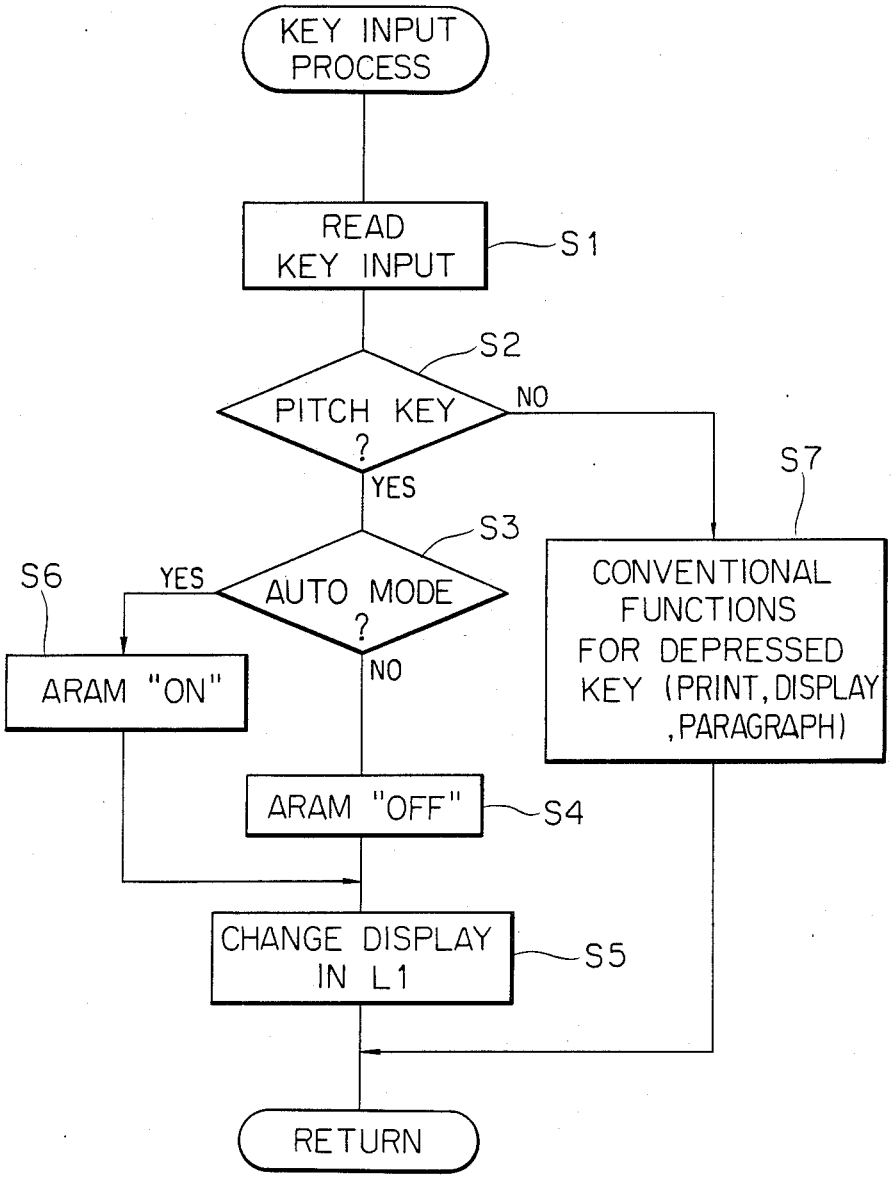
FIG. 4A is a flow chart for explaining key input processing executed by a CPU 11.
Figure 4B:
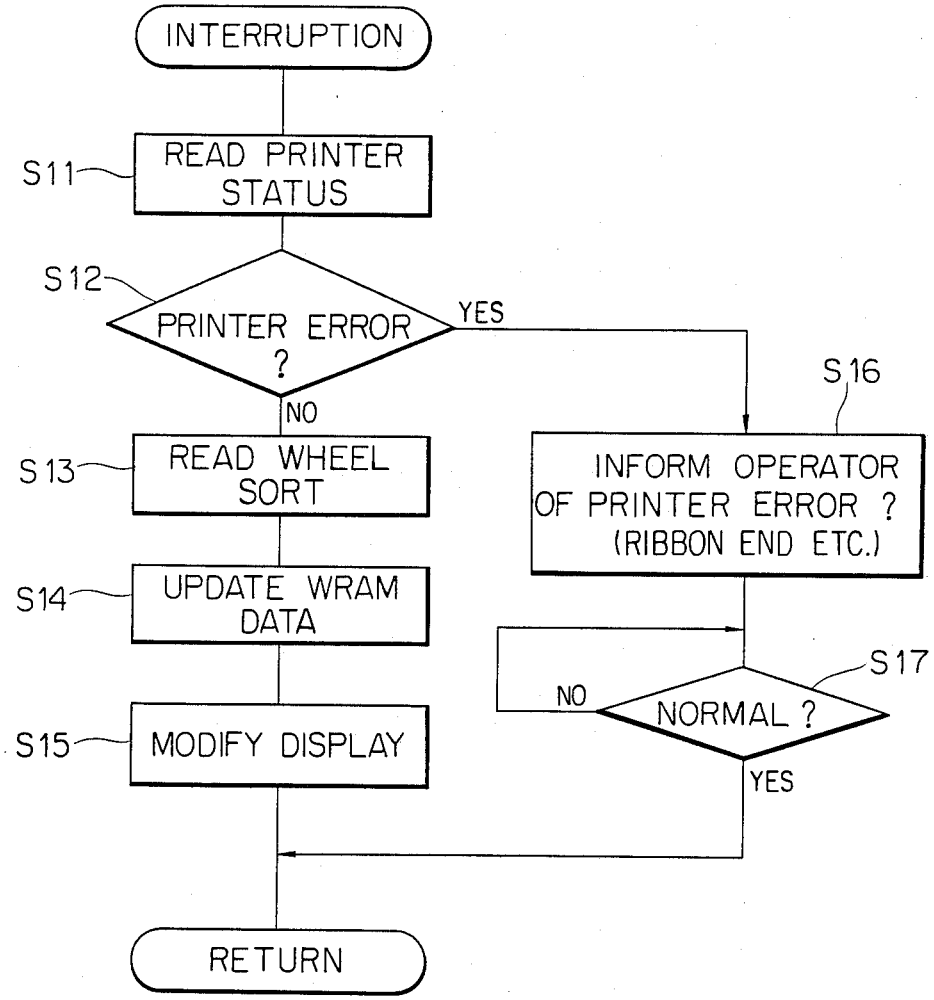
FIG. 4B is a flow chart for explaining interruption processing of the CPU 11 when an output from an AND gate in FIG. 3 is changed.

FIGS. 4A and 4B show the processing steps of operations executed by the MPU 11. FIG. 4A is a flow chart for explaining the key input processing for typewriter input separately from the printing pitch instruction input. Referring to FIG. 4A, the MPU 11 fetches a key input from the keyboard 10 in step S1. The MPU 11 checks in step S2 whether or not the key input is made upon depression of the "Pitch" key. If YES in step S2, the flow advances to step S3. The MPU 11 checks in step S3 whether or not the number of times of depression of the key indicates selection of the "Auto" mode. If YES in step S3, the ARAM 20 is held in the ON status in step S6. However, if NO in step S3, the ARAM 20 is held in the OFF status in step S4. In step S5, the selected printing pitch information is displayed on the display area L1 in FIG. 6A.

In particular, if YES is discriminated in step S3, information is displayed in accordance with the scheme shown in FIG. 6B. The printing wheels to be used in the apparatus are listed in the leftmost column. As is apparent from FIG. 6B, these wheels are a pica wheel (10 pitch), an elite wheel (12 pitch), a micron wheel (15 pitch), a pica-based proportional wheel, an elite-based proportional wheel and a micron-based proportional wheel. The display patterns "A" to "PS" in the display area L1 of FIG. 6A are listed in the uppermost column in FIG. 6B. When the instruction represents the "Auto" mode, letter "A" representing the "Auto" mode is displayed in combination with one of printing pitch information "10" to "PS" determined by the loaded printing wheel. In this case, letter "A" is displayed in response to the ON status of the ARAM 20. The printing pitch is determined by the printing wheel sort information (e.g., 0, 1, 2, 3, 4 and 5) stored in the WRAM 21. In particular, when the sort information 3, 4 or 5 is selected, letter "PS" (proportional) is also displayed.

When the instruction does not represent the "Auto" mode, the selected printing pitch is displayed irrespective of the printing wheel sort information since the printing pitch is forcibly determined upon depression of the "Pitch" key.

Referring back to FIG. 4A, if NO is discriminated in step S2, the flow advances to step S7. The key input function can be effected in the same manner as in the normal typewriter.

FIG. 4B is a flow chart for explaining interruption processing of the MPU 11 when the AND gate output in FIG. 3 goes high or low. As previously described, the output terminal AL3 of the AND gate goes low when the printer is in an abnormal state or when the upper cover 6 is kept open. In step S11, a printer status signal from the PC 17 is fetched by the MPU 11 in step S11. The MPU 11 checks in step S12 whether or not the printer is operated abnormally. If NO is discriminated in step S12, the MPU 11 determines that the cover is kept open, and the flow advances to step S13. In particular, in step S13 initiated in response to the interruption input as the AND gate output signal goes low, the MPU 11 fetches the printing wheel sort represented by the output from the OWS 19 in FIG. 3 since the printing wheel might have been replaced with a new one while the cover is kept open. The printing wheel sort data is supplied to the WRAM 21 in step S14, so that the contents of the WRAM 21 can be updated. The updated wheel sort data is supplied to the display area L1 in step S15, and display control is performed in accordance with the conditions given in FIG. 6B. Therefore, the printing wheel can be replaced with another and the display is modified accordingly in the "Auto" mode.

When the MPU 11 determines in step S12 that the printer is in an abnormal status, the operator is signalled what type of abnormality has occurred by means of a buzzer (not shown) or by a message display in step S16. The MPU 11 waits in step S17 until the abnormal status is cancelled. When the normal state is restored, interruption processing is completed.

As described above, FIGS. 6A and 6B show display areas and their display control in the apparatus. FIG. 6A is a partial enlarged view showing the details of the display areas. The display area L1 for the display patterns "10" to "PS" displays the selected printing pitch. The display area L2 displays line spacing. The display area L3 shows the printing pressure. FIG. 6B is a table for explaining the display operation for the display area L1.

Figure 5:
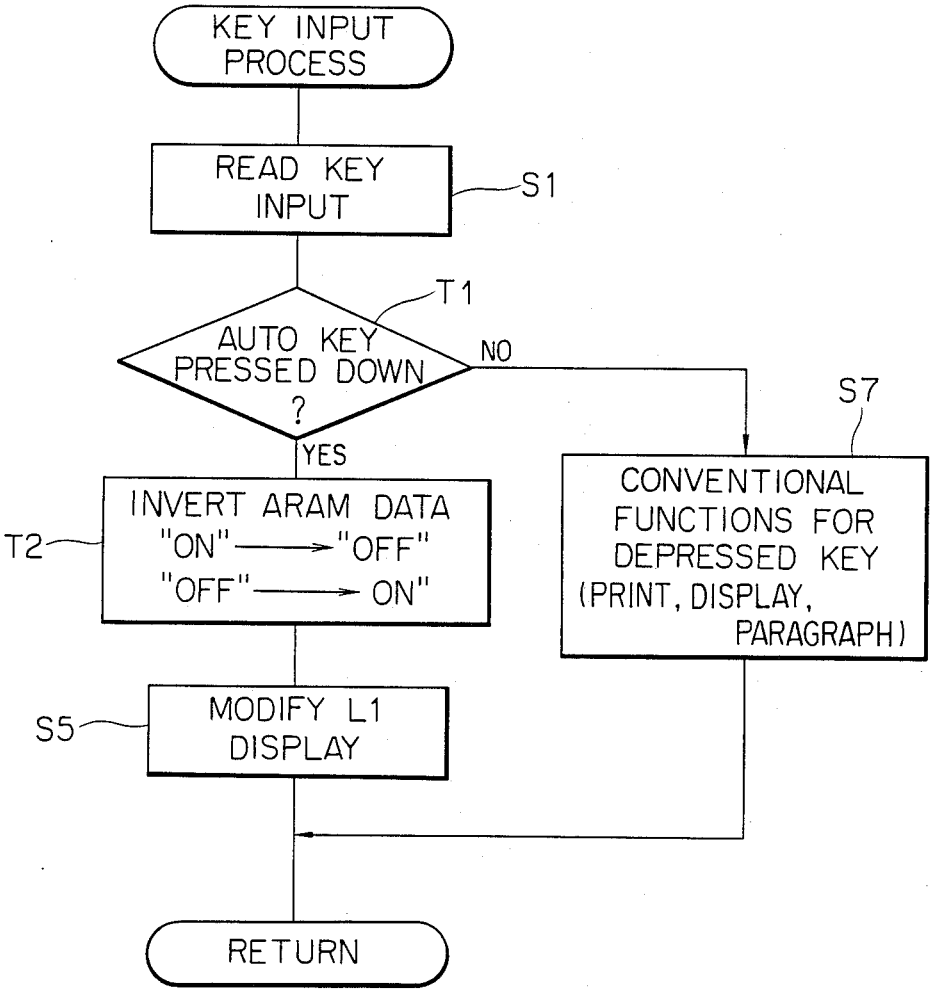
FIG. 5 is a flow chart for explaining key input processing according to another embodiment of the present invention.

In the embodiment described above, the printing pitch modes are cyclically shifted upon every depression of the "Pitch" key. However, an "Auto" key (not shown) may be separately arranged. In this case, upon depression of the "Auto" key, the mode can be updated from the manual mode to the "Auto" mode and vice versa. Although the number of keys is increased, key input is easy. Key input processing in this case will be described in FIG. 5 according to another embodiment of the present invention. The same reference numerals as in FIG. 5 denote the same steps in FIGS. 4A and 4B, and a detailed description thereof will be omitted. The MPU 11 checks in step T1 whether or not the "Auto" key is depressed. If NO is discriminated in step T1, the operation in step S7 (FIG. 4A) is performed. However, if YES is discriminated in step T1, the flow advances to step T2. The data in the ARAM 20 is inverted from the ON status to the OFF status or from the OFF status to the ON status. In other words, the auto mode and the manual mode are switched upon every depression of the "Auto" key.

It should be noted that when proportional wheels are not provided, pitch display can be performed for only the pica, elite and micron wheels in the three upper lines in FIG. 6B.

According to the present invention, even if a printing pitch must be selected from a large number of selections, necessary information can be effectively displayed within limited areas. For example, even in the auto mode for automatically setting the printing pitch in accordance with the loaded printing wheel, the "Auto" mode can be represented by the display pattern "A" and the proportional mode can be represented by the pattern "PS", thereby allowing the operator to easily identify the printing pitch. The operator need not open the cover to check the sort of printing wheel mounted in the apparatus, thereby simplying pitch selection. Furthermore, a pitch selection error can be prevented.

According to the present invention, even in the auto mode for automatically setting the printing pitch in accordance with the loaded printing wheel, the "Auto" mode can be represented by the pattern "A", so that the operator can readily identify the printing pitch. The operator need not open the cover to visually check the sort of printing wheel, thereby preventing pitch selection errors.

What I claim is:

1. A document processing system utilizing a print wheel for printing information and having characters spaced in accordance with a character pitch, said system comprising:

signal generating means for detecting the character pitch of the printing wheel and for generating a signal representing the character pitch;

switch means for switching said system between an automatic mode for automatically setting a printing pitch and a manual mode for manually setting a printing pitch;

printing pitch setting means for setting a printing pitch in accordance with the signal generated by said signal generating means in the event that said system has been switched to the automatic mode; and display means for displaying the printing pitch set by said printing pitch setting means and a pattern indicating that said system has been switched to the automatic mode in the event that said system has been switched to the automatic mode by said switch means and for displaying the printing pitch manually set by an operator and a pattern indicating that said system has been switched to the manual mode in the event that said system has been switched to the manual mode by said switch means.

2. A system according to claim 1, wherein said displaying means comprises means for displaying a pattern representing a proportional printing pitch.

3. A system according to claim 1, wherein said displaying means comprises means for separately displaying line spacing information and printing pressure information.

4. A document processing system utilizing one of a plurality of printing wheels each of a different kind, each said printing wheel for printing information with characters spaced in accordance with a printing pitch, said system comprising:

means for instructing the setting of a printing pitch;

switch means for switching said system between an automatic mode for automatically setting said printing pitch and a manual mode for manually setting said printing pitch;

a first memory for storing flag information indicating that the setting of a printing pitch has been instructed by said instructing means;

means for detecting the kind of printing wheel with which said system is to print and for outputting information representing the kind of printing wheel so detected;

a second memory for storing the printing wheel kind information output by said detecting and outputting means; and display means for displaying, in response to the flag information stored in said first memory, a pattern indicating that a printing pitch has been set and for displaying the value of a printing pitch corresponding to the printing wheel kind information stored in said second memory.

5. A system according to claim 1 further comprising means for instructing setting of a printing pitch, wherein said printing pitch setting means sets the printing pitch when the setting of a printing pitch is instructed by said instructing means.

6. A system according to claim 4, wherein said detecting and outputting means comprises an optical sensor.

7. A document processing system comprising:

input means for inputting font information including character information;

means for instructing setting of a printing pitch;

switch means for switching said system between an automatic mode for automatically setting said printing pitch and a manual mode for manually setting said printing pitch;

means for detecting the kind-of-font information input by said input means when the setting of a printing pitch is instructed by said instructing means and outputting information representing the kind of font;

memory means for storing kind-of-font information output by said detecting and outputting means; and display means for displaying the value of a printing pitch corresponding to the kind-of-font information stored in said memory means and a pattern indicating that said system has been switched to the automatic mode in the event that said system has been switched to the automatic mode and for displaying the value of a printing pitch manually set by an operator and a pattern indicating that said system has been switched to the manual mode in response to an instruction from said instruction means in the event that said system has been switched to the manual mode.

8. A system according to claim 7, wherein said display means comprises an LED.

* * * * *